US010100491B1

(12) United States Patent
Hart et al.

(10) Patent No.: US 10,100,491 B1
(45) Date of Patent: Oct. 16, 2018

(54) PLOW TUNNELING

(71) Applicant: B&H Construction, LLC, Norman, OK (US)

(72) Inventors: Ray Hart, Norman, OK (US); Steve Crossland, Purcell, OK (US)

(73) Assignee: B&H Construction, LLC, Norman, OK (US)

( * ) Notice: Subject to any disclaimer, the term of this patent is extended or adjusted under 35 U.S.C. 154(b) by 0 days.

(21) Appl. No.: 15/284,212

(22) Filed: Oct. 3, 2016

Related U.S. Application Data

(60) Provisional application No. 62/236,016, filed on Oct. 1, 2015.

(51) Int. Cl.

| | |
|---|---|
| ***E02F 5/10*** | (2006.01) |
| ***E02F 5/14*** | (2006.01) |
| ***E02F 5/02*** | (2006.01) |
| ***E02F 5/32*** | (2006.01) |

(52) U.S. Cl.
CPC ..... *E02F 5/103* (2013.01); *E02F 5/027* (2013.01); *E02F 5/326* (2013.01)

(58) Field of Classification Search
CPC ... E02F 5/027; E02F 5/10; E02F 5/101; E02F 5/102; E02F 5/103; E02F 5/32; E02F 5/326; E02F 3/80; E02D 17/13
USPC ..... 405/154.1, 157, 174–183; 111/120–126; 37/347, 366, 367, 379, 380
See application file for complete search history.

(56) References Cited

U.S. PATENT DOCUMENTS

| | | | | | |
|---|---|---|---|---|---|
| 1,765,185 | A * | 6/1930 | Umbarger | E02F 5/102 | 111/123 |
| 3,222,876 | A * | 12/1965 | Harmstorf | E02F 5/103 | 405/165 |
| 3,363,424 | A * | 1/1968 | Kaercher, Jr. | E02F 5/103 | 405/184 |
| 3,589,135 | A * | 6/1971 | Ede | E02F 5/101 | 37/370 |
| 3,760,595 | A * | 9/1973 | Stewart | A01B 13/00 | 172/40 |
| 3,914,948 | A * | 10/1975 | Kaercher, Jr. | E02F 5/103 | 172/40 |
| 4,033,271 | A | 7/1977 | Williams et al. | | |
| 4,132,181 | A | 1/1979 | Smith et al. | | |
| 4,542,940 | A * | 9/1985 | Marten | E02F 3/188 | 173/8 |
| 4,629,363 | A * | 12/1986 | Rose | E02F 5/101 | 405/155 |
| 5,281,054 | A * | 1/1994 | O'Riordan | E02F 3/3604 | 405/180 |

(Continued)

FOREIGN PATENT DOCUMENTS

GB 1267501 A1 * 3/1972

*Primary Examiner* — Frederick L Lagman
*Assistant Examiner* — Stacy N Lawson
(74) *Attorney, Agent, or Firm* — Hall Estill Attorneys at Law

(57) ABSTRACT

Apparatus and method contemplating plowing with a plow blade having a subsurface cutting edge and an opposing trailing edge. A tow link is supported by the plow blade at the trailing edge. A source of pressurized fluid is connected to a discharge conduit supported by the plow blade. The discharge conduit is supplied with pressurized fluid by the source and the discharge conduit has a discharge opening positioned to discharge the pressurized fluid adjacent the link.

17 Claims, 6 Drawing Sheets

(56) References Cited

U.S. PATENT DOCUMENTS

| | | | | |
|---|---|---|---|---|
| 5,392,541 | A * | 2/1995 | O'Riordan | E02F 3/3604 172/272 |
| 6,474,909 | B1 * | 11/2002 | Malek | E02F 5/103 111/123 |
| 6,860,336 | B2 | 3/2005 | Robillard | |
| 8,272,340 | B2 | 9/2012 | Leskiw | |
| 2002/0066214 | A1 * | 6/2002 | Miyazaki | E02F 5/101 37/367 |
| 2010/0323213 | A1 * | 12/2010 | Aitchison | B22F 5/10 428/552 |
| 2014/0079487 | A1 * | 3/2014 | Sjodahl | E02F 3/188 405/180 |

* cited by examiner

PLOW TUNNELING

RELATED APPLICATION

This application claims the benefit of the earlier filing date of U.S. patent application Ser. No. 62/236,016 which is incorporated herein by reference in its entirety.

BACKGROUND

Plows and plowing machines are used to bury a number of different types of materials such as wire, cable, pipe, tubing, and the like. Depending on the size of the buried material and the type of soil it is being buried in, plow machines range in size from small walk-along vehicles to large tractor vehicles. Smaller wires and cables (collectively "utility lines") can typically be laid into a subsurface opening with less effort by the plowing machine than larger tubes and pipes (collectively "conduits").

Laying down piping and tubing and cabling and wiring can be significantly slowed down and made more expensive by a number of variables including the ever-changing subsurface soil type and the unseeable barriers such as buried objects. Delay and cost is also typically increased by needs to change over from laying utility line to laying conduit. Improvements are needed in the art that improve the efficiency and quality with which a plow tunnels underground to lay conduits and utility lines. It is to those improvements that embodiments of this technology are directed.

SUMMARY

Some embodiments of this technology contemplate a plow blade having a subsurface cutting edge and an opposing trailing edge. A tow link is supported by the plow blade at the trailing edge. A source of pressurized fluid is connected to a discharge conduit supported by the plow blade. The discharge conduit is supplied with pressurized fluid by the source and the discharge conduit has a discharge opening positioned to discharge the pressurized fluid adjacent the link.

Some embodiments of this technology contemplate an apparatus that includes a motor vehicle and a source of pressurized fluid to the motor vehicle. A plow blade is attached to the vehicle and configured to dig a subsurface opening. An expander is towed by the plow blade in the subsurface opening. A discharge conduit is supported by the plow blade, wherein the discharge conduit is supplied with the pressurized fluid by the source and the discharge conduit has a discharge opening positioned between the plow blade and the expander.

Some embodiments of this technology contemplate a method that includes steps of: cutting an elongated opening into subsurface soil; injecting fluid into the subsurface soil in the opening; ironing the wetted subsurface soil to reshape the opening cross-section into a tunnel-shaped cavity; and towing a conduit into the subsurface tunnel-shaped cavity.

BRIEF DESCRIPTION OF THE DRAWINGS

Details of various embodiments of the present technology are described in connection with the accompanying drawings that bear similar reference numerals.

DESCRIPTION

Initially, this disclosure is by way of example only, not by limitation. The illustrative constructions and associated methods disclosed herein are not limited to use or application for any specific system or in any specific environment. That is, the disclosed technology is not limited to usage for a plow machine as is disclosed in the illustrative embodiments. Thus, although the instrumentalities described herein are for the convenience of explanation, shown and described with respect to exemplary embodiments, the skilled artisan understands that the principles herein may be applied equally in other types of systems and environments involving subsurface cutting.

Figure 1:
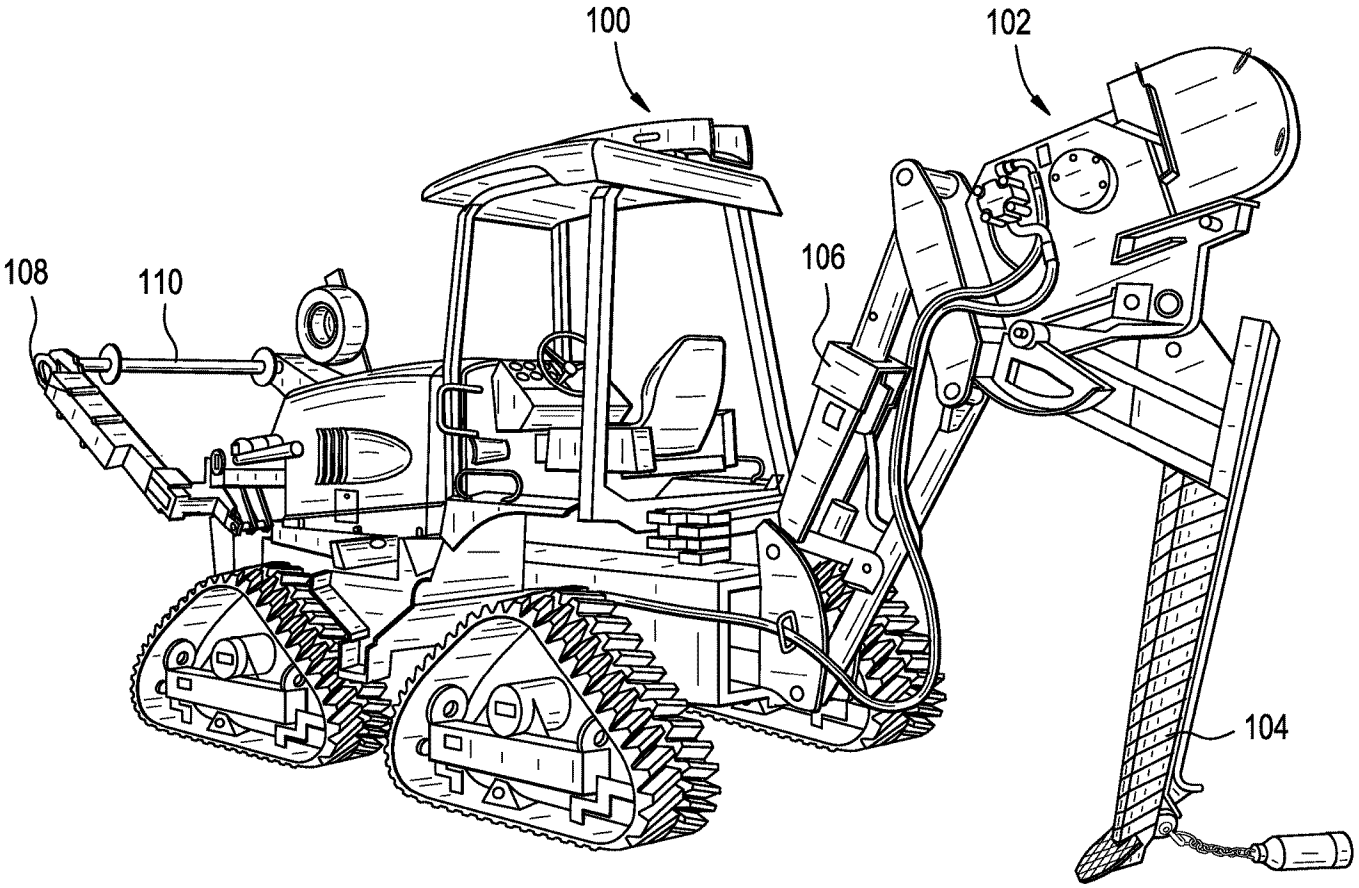
FIG. 1 depicts a tractor rigged with embodiments of this technology.

FIG. 1 depicts a large tractor-mounted rig that is outfitted for practicing the present technology. Connected as an attachment to the rear-end of the tractor 100 is a vibratory plow assembly 102. Although this description is for a vibratory plow the contemplated embodiments are not so limited. In alternative embodiments this technology is suitable for use with other types of subsurface cutting machines such as a static plow, a soil injector, and the like. An enumeration of all such suitable machines is not necessary for the skilled artisan to understand the scope of the claimed technology so no such enumeration is warranted.

The plow assembly 102 includes a plow blade 104 that can be articulated by selectively positioning a hydraulic cylinder 106 that is mounted to the rear of the tractor 100. Hydraulically-operated forks 108 on the front of the tractor 100 are depicted supporting a reel 110 onto which one or more spools of conduit and/or utility line can be mounted for feeding to the plow blade 104.

Figure 2:
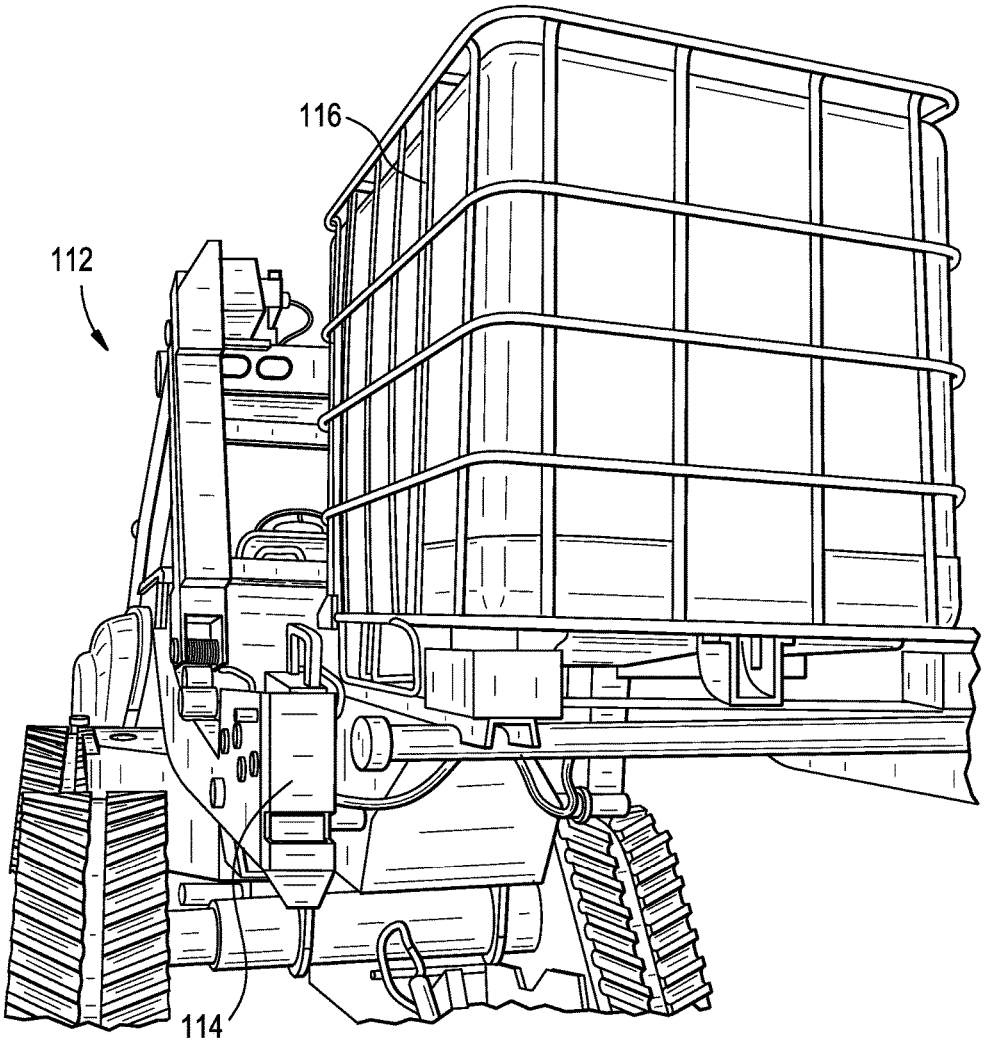
FIG. 2 is a front depiction of a skid steer rigged with embodiments of this technology.

FIG. 2 is a front depiction of a skid steer 112 that likewise has hydraulically-operated forks 114 on the front, but in this case the forks 114 support a container 116 that provides a reservoir of fluid. The fluid is preferably a polymer like that used in subsurface directional drilling, such as a number of drilling fluids marketed by Baroid Industrial Drilling Products.

Figure 3:
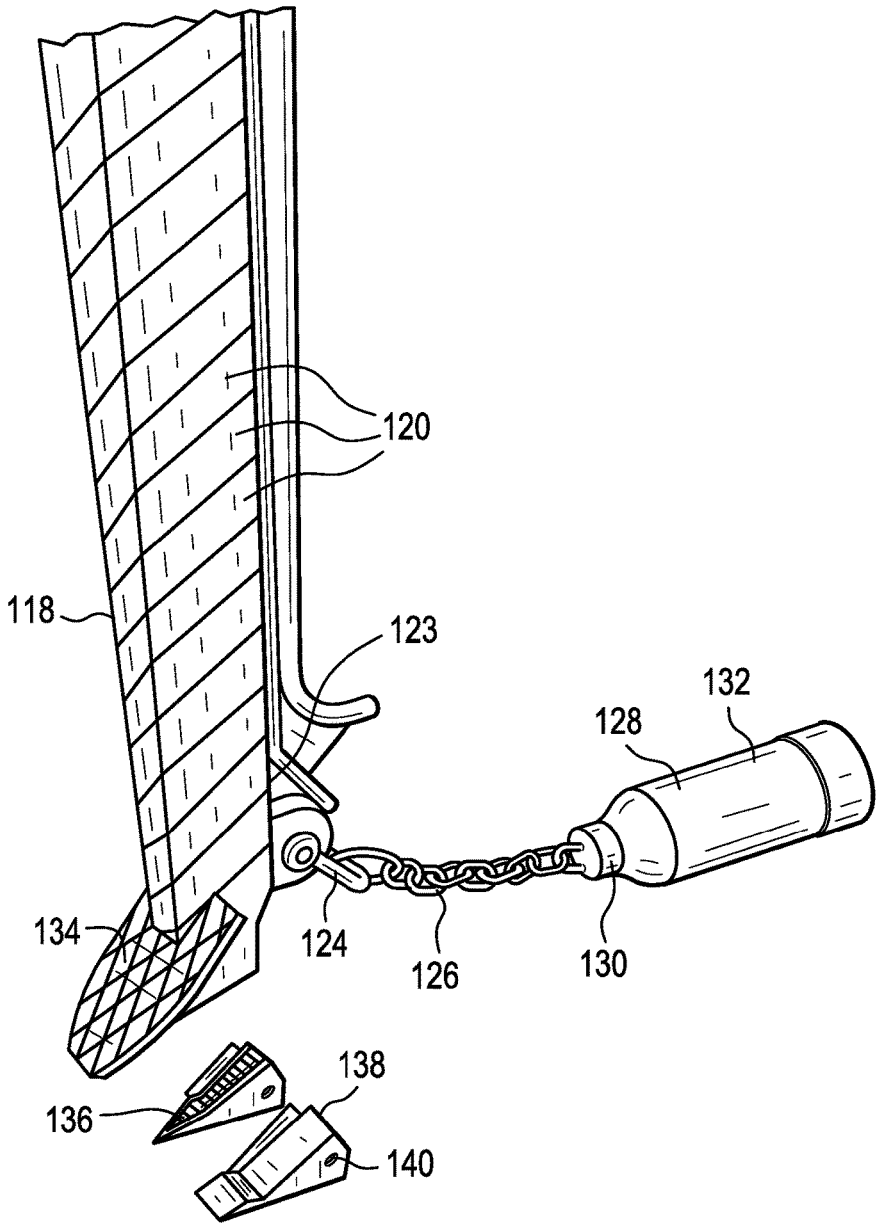
FIG. 3 is a plow blade that is constructed in accordance with embodiments of this technology.

FIG. 3 is an enlarged detail of the vibratory plow 104 in these illustrative embodiments of construction and use. The vibratory plow 104 has a leading cutting edge 118 configured to cut into the subsurface soil. A webbed pattern of tungsten carbide material 120 is welded to the cutting edge 118 and the sides of the plow 104 to extend the wear life of the materials of construction. A tow link 122 in these illustrative embodiments is a tang attached to the lower end of the plow blade 104, on a trailing edge 123 opposing the cutting edge 118. A clevis 124 is removably connect to the tow link 122 and is, in turn, connected to a flexible linkage such as the chain 126. The other end of the chain 126 is connected to an expander 128.

Thus, forward motion of the vehicle (tractor 100 or skid steer 112) causes the plow blade 104 as it is cutting through subsurface soil at a selected depth to also tow the expander 128 at that depth through the subsurface soil. The expander (sometimes referred to as a "bullet") 128 has a tapered nose 130 to easier tow it into the subsurface cut made by the plow blade 104. That is, the subsurface cut is substantially a vertical cut through which a round conduit is towed. The expander 128 transitions in cross sectional size from the nose 130 to a larger-diameter body 132 that is sized to reshape the vertical cut into a rounded opening that facilitates towing a conduit (not depicted) through the opening.

A drafting bit 134 is depicted attached for use with the vibratory plow 104. The drafting bit 134 can be angled slightly downward into the earth as the vehicle 100, 112 moves forward to draft the plow cutting action to the desired subsurface depth. The drafting bit 134 forms a relatively large contact surface area, one that is wider that the width of the plow blade 104, to both stabilize the plow blade 104 during cutting and to shear the soil at the bottom end of the cut subsurface soil. Using the drafting bit 134 is limited to loose soil conditions, free of inhibitors to drafting such as rock, heavy roots or vegetation, heavy clay veins, and the like. Alternative bits 136, 138 are narrower and sharper so they are well suited for making one or more initial passes in difficult soil conditions prior to laying the conduit. Each bit 134, 136, 138 is secured to the plow blade 104 by a drift pin (not depicted) that engages both the plow blade 104 and a hole (such as 140) formed in the bit. This construction makes the bits readily interchangeable for compensating quickly and easily for different soil conditions.

Figure 4:
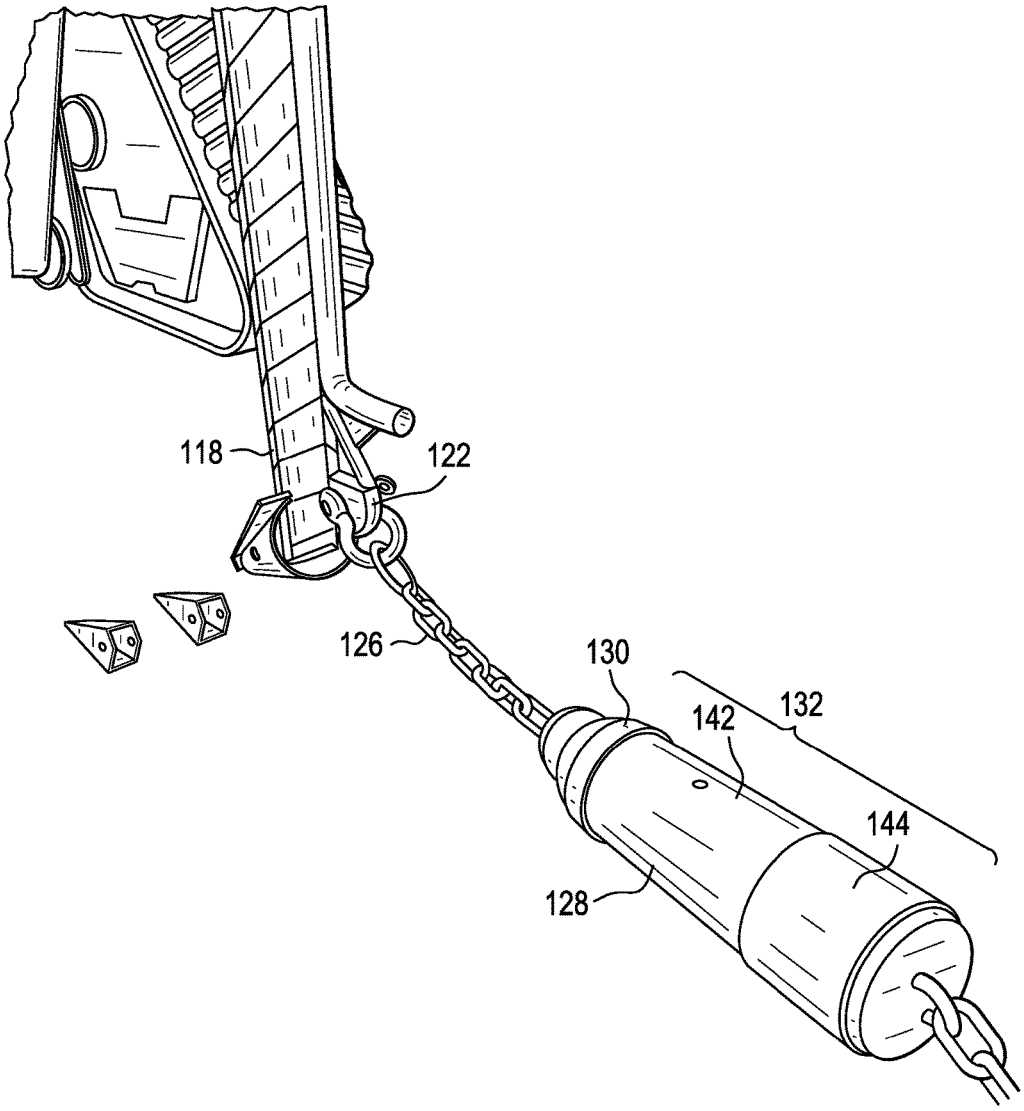
FIG. 4 is a rear depiction of the plow blade of FIG. 3.

FIG. 4 is similar to FIG. 3 but depicting a rear view of the manner in which the plow blade 104 cuts a subsurface opening by moving the cutting edge 118 into the soil and tows the expander 128 through that subsurface opening. In these illustrative embodiments the expander body 132 has a comparably smaller-diameter leading portion 142 and a larger-diameter trailing portion 144. The gradual and smooth increases in diameter from the nose 130 to the trailing portion 144 facilitate entry of the expander 128 into the subsurface opening and incrementally enlarge the opening to reduce the forces needed to tow the expander 128 through the subsurface opening.

Figure 5:
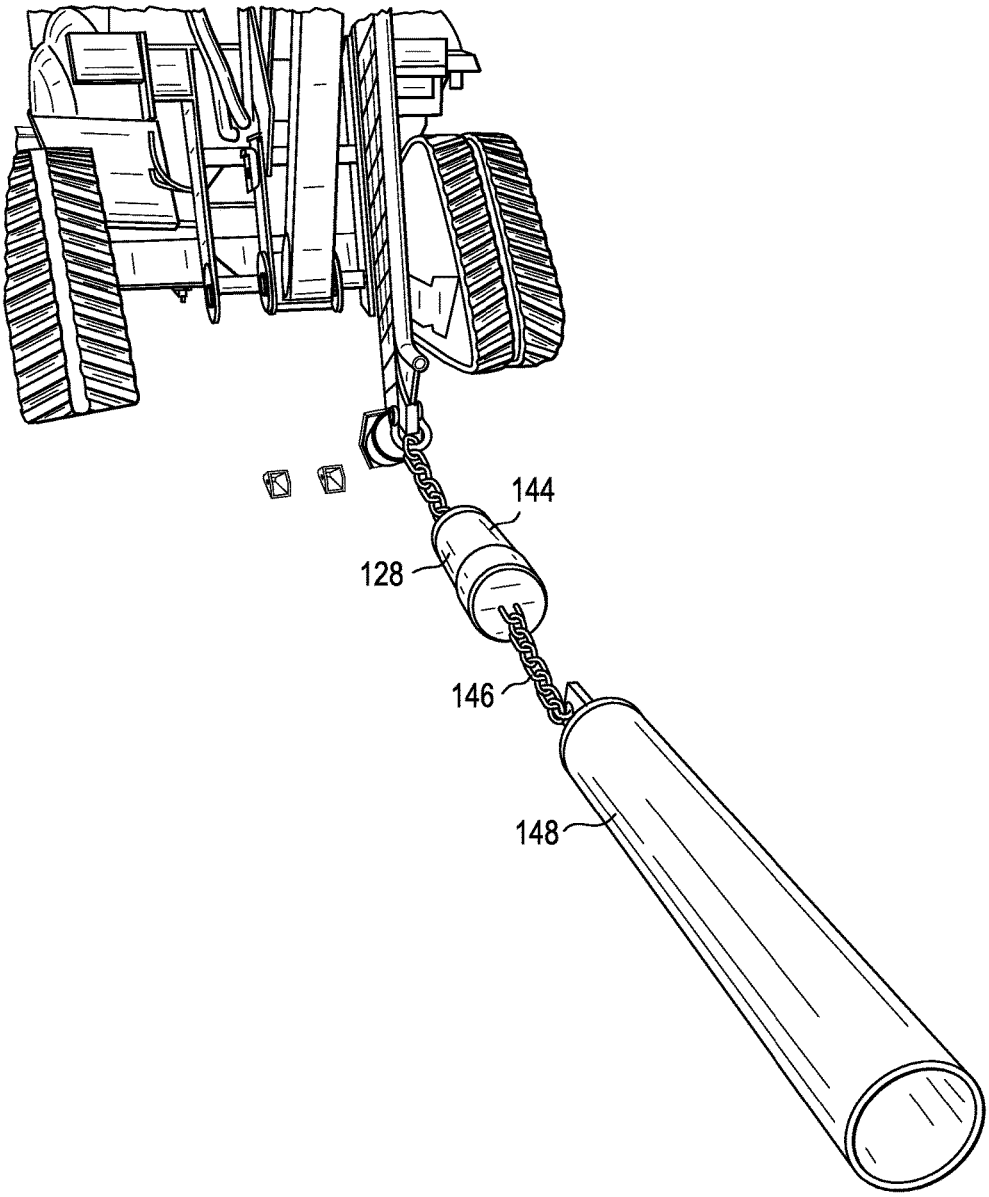
FIG. 5 is similar to FIG. 4 but also depicting a headstock in accordance with embodiments of this technology.

FIG. 5 is similar to FIG. 4 but also depicting the trailing portion 144 of the expander 128 is connected by another flexible link, such as a chain 146, to a headstock 148. The conduit (not depicted) is connected to the headstock 148 such as by pinning or clamping them together. The plow blade 104 thus tows the expander 128 which, in turn, tows the headstock 148 and conduit (not depicted) through the subsurface opening cut by the plow blade and shaped by the expander 128.

Figure 6:
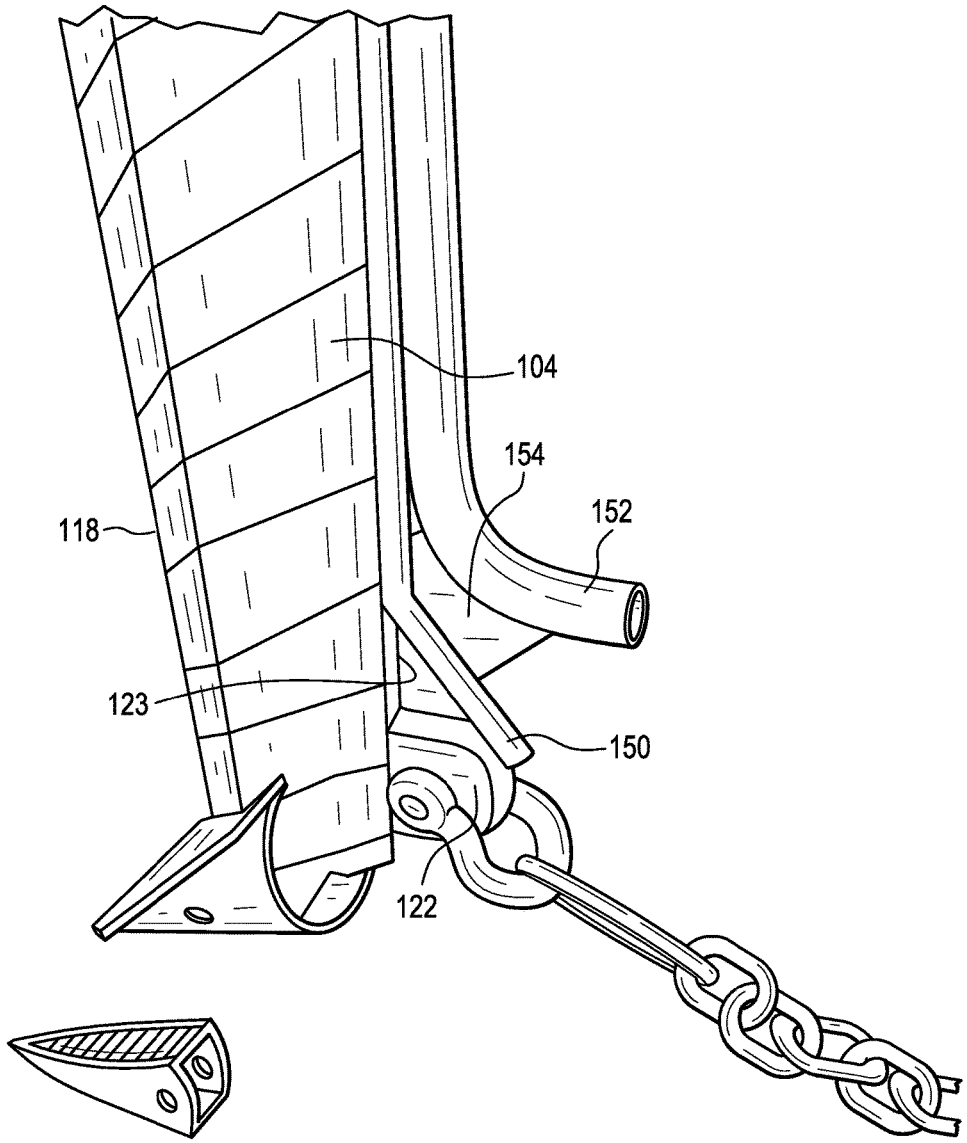
FIG. 6 is an enlarged detail depiction of a portion of FIG. 3.

FIG. 6 is an enlarged depiction of a portion of FIG. 2 more particularly depicting details of construction for these illustrative embodiments of this technology. A discharge conduit 150 is supplied by a source of pressurized fluid. For example, in these illustrative embodiments the discharge conduit 150 can be fluidly connected to the container 116 (FIG. 2) to provide a vehicle 112 with a self-contained supply of pressurized fluid. The fluid can be pressurized by the force of gravity, or alternatively a fluid pump (not depicted) can be inserted in the fluid pathway to pressurize the fluid. A valve (not depicted) can also be provided in the fluid pathway so that fluid flow from the supply can be stopped when fluid is not needed. The pump and valve controls, along with other controls and instrumentation, can be located in the vehicle cab so that an operator can reach and use them from the confines of the cab.

In these illustrative embodiments the discharge conduit 150 is connected to the trailing edge 123 of the plow blade 104, such as by welding. A bottom end of the discharge conduit 150 is connected to a top side of the tow link 122, such as by welding. That construction provides a rigid support of the discharge conduit 150 to withstand the subsurface soil forces acting against the plow blade 104 as it cuts into the subsurface soil. In these embodiments the discharge conduit 150 is a tube with an open end pointed down to discharge the pressurized fluid adjacent the tow link 122.

The pressurized fluid is thus pumped into the subsurface opening between the plow body 104 and the bullet 128. This construction injects the pressurized fluid into the subsurface opening at the longitudinal centerline of the expander 128 while being towed by the plow blade 104. The fluid advantageously immerses and conditions the subsurface soil in the opening prior to it being shaped by the bullet 102. Wetting the soil first with the fluid prepares the soil to effectively be "ironed" into the cross-sectional shape of the bullet 128 to better hold the cylindrical-shaped-tunnel in the subsurface soil through which towing the headstock 148 and conduit is facilitated by requiring less time and less power to lay the conduit. Injecting the fluid immediately downstream of the plow blade 104 and upstream of the expander 128 conditions the soil for optimally forming an elongated tunnel-shape by the expander 128 in the subsurface soil. The injected fluid effectively makes a pliable soil material that can readily be shaped by the expander 128 into the cylindrical cross-sectional shape matching the conduit shape. The expander 128 irons the conditioned soil, pushing the fluid out and downstream into the subsurface soil to residually strengthen the shaped soil to better hold its cylindrical-shaped elongated subsurface tunnel for insertion of the conduit.

A chute tube 152 in these illustrative embodiments is connected to the discharge conduit 152 for guiding a utility line (not depicted) into the subsurface opening that is cut by the plow blade 104. The chute tube 152 can be supplied with a utility line or a conduit from a spool of the material that can be supported on the reel 110 (FIG. 1) on the front of the vehicle 100. A web 154 is attached to a top side of the discharge conduit 150 and to a bottom side of the chute tube 152, providing support against the forces of the subsurface soil through which the chute tube 152 is moved. The tungsten carbide welds for increasing the wear resistance can be extended to protect the discharge conduit 150 and/or the chute tube 152 as well.

Flexibility and freedom of action is gained by the embodiments of this technology affording a vibratory plow suited for either laying smaller utility lines or larger conduit. The operator can switch from one to another, or perhaps run both at the same time because the plow blade 104 is equipped with both the chute tube 152 and the discharge conduit 150.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed:

1. An apparatus comprising:

a plow blade having a cutting edge and an opposing trailing edge, the edges configured to cut a longitudinally-directed subsurface trench defined by a top, a bottom, and opposing sides of the subsurface trench;

a flexible linkage attached to the plow blade and configured with freedom to move laterally toward the sides of the trench;

an expander attached to a distal end of the flexible linkage so that movement of the plow blade, via the flexible linkage, provides the only force moving the expander in the direction of the plow blade to diametrically expand the subsurface trench;

a source of pressurized fluid; and a discharge conduit supported by the plow blade that is supplied with the pressurized fluid by the source, an end of the discharge conduit having a discharge opening and being supported by a tow link positioned at the trailing edge of the plow blade and configured for direct attachment with the flexible linkage so that the discharge opening is positioned to discharge the pressurized fluid between the trailing edge of the plow blade and the expander.

2. The apparatus of claim 1 further comprising a bit connected to a bottom end of the plow blade.

3. The apparatus of claim 2 wherein the bit is a draft bit.

4. The apparatus of claim 1 further comprising a chute tube mounted to the trailing edge.

5. The apparatus of claim 4 wherein the discharge conduit is attached to the trailing edge and the chute tube is attached to the discharge conduit.

6. The apparatus of claim 1 wherein the tow link is configured to tow the expander in the subsurface trench behind the plow blade.

7. The apparatus of claim 6 wherein the tow link is configured to tow a headstock behind the expander.

8. The apparatus of claim 1 further comprising carbide material welded on the plow blade and extending between the cutting edge and the trailing edge.

9. The apparatus of claim 1 wherein the tow link is at a lowermost portion of the trailing edge.

10. The apparatus of claim 9 wherein the discharge conduit is an open-end tube.

11. The apparatus of claim 1 wherein the tow link comprises a tang.

12. An apparatus comprising:

a motor vehicle;

a source of pressurized fluid;

a plow blade attached to the vehicle and configured to dig a longitudinally-directed subsurface opening defined by a top, a bottom, and opposing sides of the subsurface opening;

a flexible linkage attached to the plow blade and configured with freedom to move laterally toward the sides of the subsurface opening;

an expander attached to a distal end of the flexible linkage so that movement of the plow blade, via the flexible linkage, provides the only force moving the expander in the direction of the plow blade to diametrically expand the subsurface opening; and a discharge conduit supported by the plow blade that is supplied with the pressurized fluid by the source, an end of the discharge conduit having a discharge opening and being supported by a tow link positioned at the trailing edge of the plow blade and configured for direct attachment with the flexible linkage so that the discharge opening is positioned to discharge the pressurized fluid between the plow blade and the expander.

13. The apparatus of claim 12 wherein the source comprises a self-contained reservoir in the motor vehicle.

14. The apparatus of claim 12 wherein the source comprises a pump.

15. The apparatus of claim 12 wherein the source comprises a valve.

16. The apparatus of claim 12 further comprising a headstock towed by the expander in the subsurface opening.

17. A method, comprising:

obtaining a plow blade having a cutting edge and an opposing trailing edge configured to cut a longitudinally-extending subsurface trench defined by a top, a bottom, and opposing sides of the subsurface trench, a flexible linkage having a proximal end attached to the plow blade and configured with freedom to move laterally toward the sides of the subsurface trench, an expander attached to a distal end of the flexible linkage so that movement of the plow blade, via the flexible linkage, provides the only force moving the expander in the direction of the plow blade to diametrically expand the subsurface trench, a source of pressurized fluid; and a discharge conduit supported by the plow blade, an end of the discharge conduit having a discharge opening and being supported by a tow link positioned at the trailing edge of the plow blade and configured for direct attachment with the flexible linkage so that the discharge opening is positioned to discharge the pressurized fluid between the plow blade and the expander;

moving the plow blade to cut the subsurface trench into subsurface soil;

discharging the pressurized fluid through the discharge opening to wet the subsurface trench between the plow blade and the expander;

diametrically expanding the wetted subsurface trench with the expander as it is moved by the plow blade and the flexible linkage; and towing a conduit in the expanded subsurface trench.

* * * * *